US011976852B2

(12) United States Patent
Wakisaka

(10) Patent No.: US 11,976,852 B2
(45) Date of Patent: May 7, 2024

(54) AIR CONDITIONER AND CUT-OFF VALVE

(71) Applicant: DAIKIN INDUSTRIES, LTD., Osaka (JP)

(72) Inventor: Shigetaka Wakisaka, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 420 days.

(21) Appl. No.: 17/365,317

(22) Filed: Jul. 1, 2021

(65) Prior Publication Data

US 2021/0325068 A1 Oct. 21, 2021

Related U.S. Application Data

(63) Continuation of application No. PCT/JP2019/045845, filed on Nov. 22, 2019.

(30) Foreign Application Priority Data

Jan. 2, 2019 (JP) ..... 2019-008842

(51) Int. Cl.
*F24F 11/36* (2018.01)
*F25B 13/00* (2006.01)
(Continued)

(52) U.S. Cl.
CPC ..... *F25B 13/00* (2013.01); *F24F 11/36* (2018.01); *F25B 41/20* (2021.01); *F25B 41/24* (2021.01);
(Continued)

(58) Field of Classification Search
CPC ..... F25B 13/00; F25B 11/36; F25B 11/37; F25B 11/38; F25B 41/20; F25B 41/24;
(Continued)

(56) References Cited

U.S. PATENT DOCUMENTS

2012/0272672 A1* 11/2012 Morimoto ..... F25B 41/20 62/126
2014/0033754 A1 2/2014 Hatomura et al.
(Continued)

FOREIGN PATENT DOCUMENTS

AU 2016284145 B2 * 1/2019 ..... F24F 11/89
EP 3346211 A1 7/2018
(Continued)

OTHER PUBLICATIONS

English translation of International Preliminary Report on Patentability and Written Opinion of the International Searching Authority for International Application No. PCT/JP2019/045845, dated Jul. 15, 2021.
(Continued)

*Primary Examiner* — Miguel A Diaz
(74) *Attorney, Agent, or Firm* — Birch, Stewart, Kolasch & Birch, LLP

(57) ABSTRACT

A utilization unit has a power source configured to receive electric power supplied from a power source system and
(Continued)

supplies operating electric power. At least one of the first cut-off valve or the second cut-off valve is an external cut-off valve provided outside the utilization unit. The external cut-off valve is driven using the operating electric power supplied from the power source.

11 Claims, 6 Drawing Sheets

(51) Int. Cl.
*F25B 41/20* (2021.01)
*F25B 41/24* (2021.01)
*F25B 49/02* (2006.01)

(52) U.S. Cl.
CPC ..... *F25B 49/025* (2013.01); *F25B 2500/222* (2013.01)

(58) Field of Classification Search
CPC ..... F25B 49/025; F25B 2500/22; F25B 2500/221; F25B 2500/222; F24F 11/36; F24F 11/37; F24F 11/38
See application file for complete search history.

(56) References Cited

U.S. PATENT DOCUMENTS

| | | | | |
|---|---|---|---|---|
| 2018/0180338 | A1* | 6/2018 | Honda | F25B 41/20 |
| 2019/0368752 | A1 | 12/2019 | Shiohama et al. | |
| 2020/0011580 | A1* | 1/2020 | Matsuda | F25B 49/022 |
| 2022/0364750 | A1* | 11/2022 | Sasayama | F24F 7/007 |

FOREIGN PATENT DOCUMENTS

| | | | |
|---|---|---|---|
| JP | 47-17959 | U | 10/1972 |
| JP | 8-251800 | A | 9/1996 |
| JP | 2009-145026 | A | 7/2009 |
| JP | 2011-247755 | A | 12/2011 |
| JP | 2012-13339 | A | 1/2012 |
| JP | 2013-19621 | A | 1/2013 |
| JP | 2018-115781 | A | 7/2018 |
| WO | WO 2012/160598 | A1 | 11/2012 |
| WO | WO 2016/135925 | A1 | 9/2016 |
| WO | WO 2017/037841 | A1 | 3/2017 |

OTHER PUBLICATIONS

International Search Report for PCT/JP2019/045845 dated Jan. 7, 2020.

* cited by examiner

FIG.6

| ASHRAE Number | COMPONENT | mass% | Alternative |
|---|---|---|---|
| R1234yf | R1234yf | (100) | R134a |
| R1234ze(E) | R1234ze(E) | (100) | R134a |
| | R1234yf/R134a/R152a | (82/7/11) | R134a |
| R516A | R1234yf/R134a/R152a | (77.5/8.5/14.0) | R134a |
| R445A | R744/R134a/R1234ze(E) | (6.0/9.0/85.0) | R134a |
| R444A | R32/R152a/R1234ze(E) | (12/5/83) | R134a |
| | R32/R125/R1234yf | (15/25/60) | R22/407 |
| R454C | R32/R1234yf | (21.5/78.5) | R22/407 |
| | R32/R152a/R1234ze(E) | (45/20/35) | R22/407 |
| R444B | R32/R152a/R1234ze(E) | (41.5/48.5/10) | R22/407 |
| | R744/R32/R1234ze(E) | (7/30/63) | R22/407 |
| R454A | R32/R1234yf | (35/65) | R404A |
| R454A | R32/R1234yf | (35/65) | R404A |
| R454C | R32/R1234yf | (21.5/78.5) | R404A |
| | R32/R1234yf/R152a/R1234ze(E) | (40/20/10/30) | R404A |
| R455A | R744/R32/R1234yf | (3.0/21.5/75.5) | R404A |
| | R32/R1234yf/R134a | (28/51/21) | R404A |
| | R32/R1234yf/R152a | (35/55/10) | R404A |
| | R32/R1234yf | (29/71) | R404A |
| | R-32/R290/R1234yf | (21.0/7.9/71.1) | R404A |
| R457A | R32/R1234yf/R152a | (18/70/12) | R404A |
| R459B | R32/R1234yf/R1234ze(E) | (21/69/10) | R404A |
| | R32/R134a | (50/50) | R404A |
| | R32/R1234yf | (40/60) | R410A |
| R452B | R32/R125/R1234yf | (67/7/26) | R410A |
| | R32/R1234yf | (72.5/27.5) | R410A |
| R454B | R32/R1234yf | (68.9/31.1) | R410A |
| | R32/R125/R1234ze(E) | (68/15/17) | R410A |
| R447B | R32/R125/R1234ze(E) | (68/8/24) | R410A |
| R32 | R32 | (100) | R410A |
| R447A | R32/R1234ze(E)/R125 | (68/28.5/3.5) | R410A |
| | R32/R1234yf/R1234ze(E) | (73/15/12) | R410A |
| | R32/R1234ze(E) | (72/27) | R410A |
| R446A | R32/R1234ze(E)/Butane | (68/29/3) | R410A |
| | R32/R1234yf/R134a | (50/40/10) | R410A |
| R459A | R32/R1234yf/R1234ze(E) | (68/26/6) | R410A |
| | R1123/R32 | (32/68) | R410A |
| | R1123/R32 | (40/60) | R410A |
| | R1123/R32 | (45/55) | R410A |
| | R1123/R32/R1234yf | (19/55/26) | R410A |
| | R1123/R32/R1234yf | (40/44/16) | R410A |
| | R1123 | (100) | R410A |
| | R744/R32/R1234ze(E) | (6/60/34) | R410A |
| | R32/R134a/R1234ze | (76/6/18) | R410A |
| | R32/R152a | (95/5) | R410A |
| | R32/R134a | (95/5) | R410A |

AIR CONDITIONER AND CUT-OFF VALVE

CROSS REFERENCE TO RELATED APPLICATIONS

This application is a Continuation of PCT International Application No. PCT/JP2019/045845, filed on Nov. 22, 2019, which claims priority under 35 U.S.C. 119(a) to Patent Application No. 2019-008842, filed in Japan on Jan. 2, 2019, all of which are hereby expressly incorporated by reference into the present application.

TECHNICAL FIELD

The present disclosure relates to an air conditioner and a cut-off valve.

BACKGROUND ART

Patent Document 1 discloses an air conditioner including an outdoor unit and a plurality of indoor units connected to the outdoor unit via refrigerant pipes. This air conditioner includes an externally mounted device, a first control unit, a second control unit, and a refrigerant leakage detector. The externally mounted device has expansion valves connected to respective one ends of the refrigerant pipes connecting between the indoor unit and the outdoor unit and electromagnetic valves connected to the respective other ends. The first control unit is provided in the outdoor unit. The second control unit is provided in the indoor unit. The externally mounted device includes a third control unit which transmits/receives signals to/from the first control unit, the second control unit, and the refrigerant leakage detector. The third control unit closes the expansion valves and the electromagnetic valves, based on information transmitted from the refrigerant leakage detector at the time of refrigerant leakage.

CITATION LIST

Patent Document

PATENT DOCUMENT 1: Japanese Unexamined Patent Publication No. 2012-13339

SUMMARY

A first aspect of the present disclosure is directed to an air conditioner including: a refrigerant circuit (10*a*) including: a heat source circuit (20*a*) having a compressor (21) and a heat source heat exchanger (23); a utilization circuit (30*a*) having a utilization heat exchanger (31); a first refrigerant channel (41) connected to a gas end of the utilization circuit (30*a*); and a second refrigerant channel (42) connected to a liquid end of the utilization circuit (30*a*), and configured to circulate a refrigerant to perform a refrigeration cycle; a heat source unit (20) including the heat source circuit (20*a*); a utilization unit (30) including the utilization circuit (30*a*); a first cut-off valve (51) provided in the first refrigerant channel (41); and a second cut-off valve (52) provided in the second refrigerant channel (42), the first cut-off valve (51) and the second cut-off valve (52) being placed in a closed state from an open state in response to a leakage of the refrigerant in the utilization circuit (30*a*), the utilization unit (30) having a power source (33) configured to receive electric power supplied from a power source system and supplies operating electric power, at least one of the first cut-off valve (51) or the second cut-off valve (52) being an external cut-off valve (61) provided outside the utilization unit (30), and the external cut-off valve (61) being driven using the operating electric power supplied from the power source (33).

BRIEF DESCRIPTION OF THE DRAWINGS

FIG. 6 is a table showing refrigerants used in a refrigerant circuit of an air conditioner.

DESCRIPTION OF EMBODIMENTS

Figure 1:
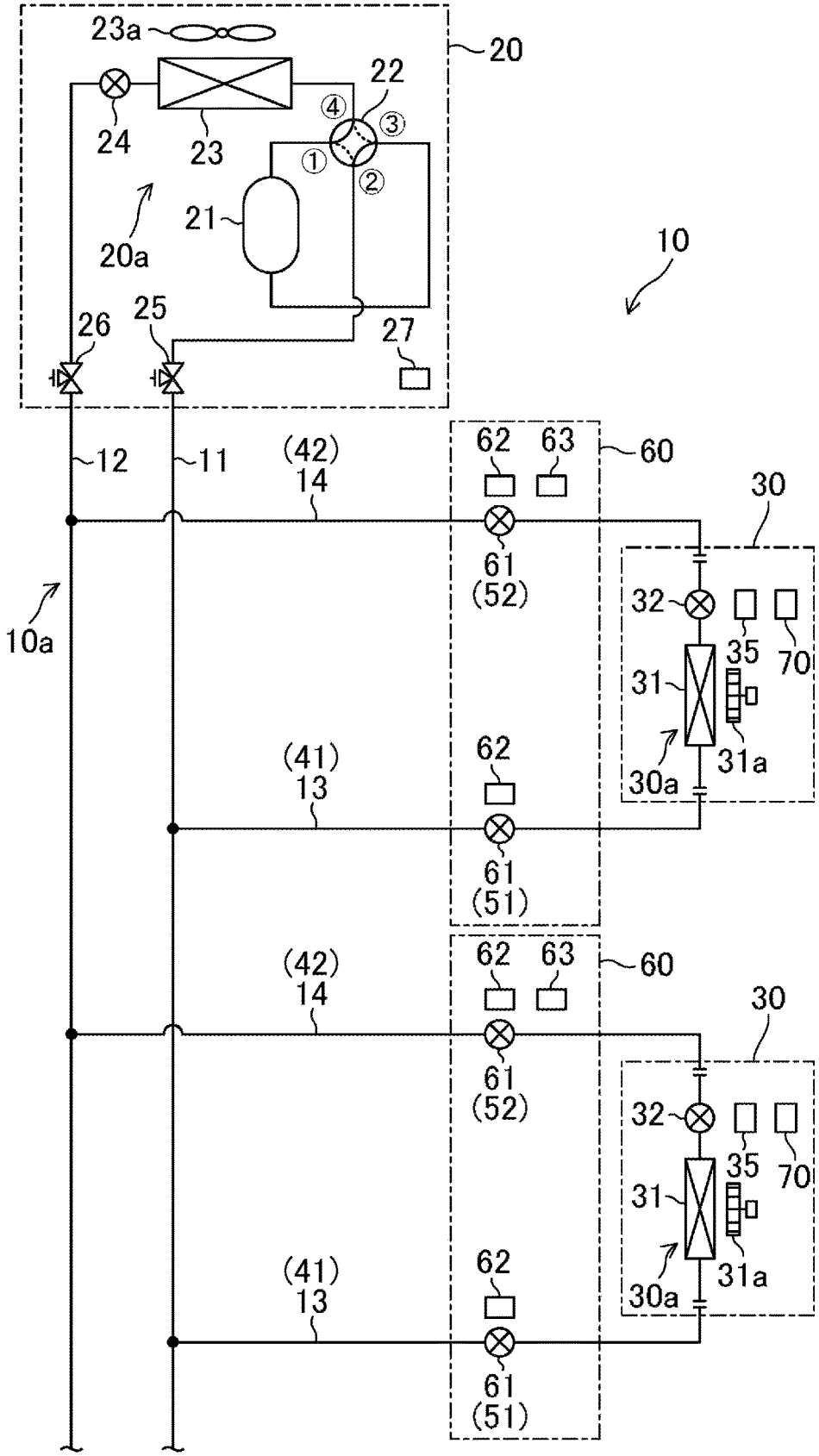
FIG. 1 is a piping system diagram illustrating a configuration of an air conditioner according to an embodiment.

Embodiments will now be described in detail with reference to the drawings. Note that the same reference characters denote the same or equivalent components in the drawings, and the description thereof will not be repeated.

(Air Conditioner)

FIG. 1 illustrates a configuration of an air conditioner (10) according to an embodiment. The air conditioner (10) conditions air in a space to be air-conditioned (e.g., an indoor space). Specifically, the air conditioner (10) switches between a cooling operation and a heating operation. In this example, the air conditioner (10) includes a heat source unit (20) and a plurality of utilization units (30). The air conditioner (10) is a so-called multiple air conditioner.

[Heat Source Unit and Utilization Unit]

The heat source unit (20) is installed in a space (e.g., an outdoor space) which is not the space to be air-conditioned. The utilization units (30) are installed in the space to be air-conditioned. For example, one utilization unit (30) may be installed in one space to be air-conditioned, or two or more utilization units (30) may be installed in one space to be air-conditioned. The configurations of the heat source unit (20) and the utilization units (30) will be described in detail later.

[Refrigerant Circuit]

As illustrated in FIG. 1, the air conditioner (10) includes a refrigerant circuit (10*a*). The refrigerant circuit (10*a*) is filled with a refrigerant. The refrigerant circulates in the refrigerant circuit (10*a*) to perform a vapor compression refrigeration cycle. In this example, the refrigerant circuit (10*a*) includes a heat source circuit (20*a*), a plurality of utilization circuits (30*a*), a plurality of first refrigerant channels (41), and a plurality of second refrigerant channels (42).

The heat source circuit (20*a*) is provided in the heat source unit (20). The utilization circuits (30*a*) are provided in the respective utilization units (30). In other words, one utilization circuit (30*a*) is provided in one utilization unit (30). The configurations of the heat source circuit (20*a*) and the utilization circuits (30*a*) will be described in detail later.

At least one of the utilization circuits (30*a*) is associated with each of first refrigerant channels (41). At least one of the utilization circuits (30*a*) is associated with each of second refrigerant channels (42). In this example, one utilization circuit (30*a*) is associated with a combination of one first refrigerant channel (41) and one second refrigerant channel (42).

Each of the first refrigerant channels (41) is connected to the gas end of associated one of the utilization circuits (30*a*). Each of the first refrigerant channels (41) is connected directly or indirectly to the gas end of the heat source circuit (20*a*). With such a configuration, the gas end of each of the utilization circuits (30*a*) is connected to the gas end of the heat source circuit (20*a*) through associated one of the first refrigerant channels (41).

Each of the second refrigerant channels (42) is connected to the liquid end of the associated one of the utilization circuits (30*a*). Each of the second refrigerant channels (42) is connected directly or indirectly to the liquid end of the heat source circuit (20*a*). With such a configuration, the liquid end of each of the utilization circuits (30*a*) is connected to the liquid end of the heat source circuit (20*a*) through associated one of the second refrigerant channels (42).

In this example, the gas end of the heat source circuit (20*a*) is connected to one end of a gas connection pipe (11), and the liquid end of the heat source circuit (20*a*) is connected to the one end of a liquid connection pipe (12). The gas connection pipe (11) is connected to one ends of a plurality of gas branch pipes (13). The gas branch pipes (13) are associated with the respective utilization circuits (30*a*). Each of the gas branch pipes (13) is connected to the gas end of associated one of the utilization circuits (30*a*). The liquid connection pipe (12) is connected to one ends of a plurality of liquid branch pipes (14). The liquid branch pipes (14) are associated with the respective utilization circuits (30*a*). Each of the liquid branch pipes (14) is connected to the liquid end of the associated one of the utilization circuits (30*a*). The gas branch pipes (13) each have a pipe diameter larger than the pipe diameters of the liquid branch pipes (14). For example, the gas branch pipes (13) are pipes with an outer diameter of 12.7 mm or 15.9 mm.

As described above, in this example, the first refrigerant channels (41) are configured as the gas branch pipes (13). The second refrigerant channels (42) are configured as the liquid branch pipes (14). The gas end of the heat source circuit (20*a*) is configured as a gas stop valve (25), which will be described later. The liquid end of the heat source circuit (20*a*) is configured as a liquid stop valve (26), which will be described later. The gas end of each of the utilization circuits (30*a*) is configured as a gas-side joint of each of the utilization circuits (30*a*). The liquid end of each of the utilization circuits (30*a*) is configured as a liquid-side joint of each of the utilization circuits (30*a*).

[Configuration of Heat Source Unit]

The heat source unit (20) is provided with the heat source circuit (20*a*). The heat source circuit (20*a*) has a compressor (21), a four-way switching valve (22), a heat source heat exchanger (23), a heat source expansion valve (24), a gas stop valve (25), and a liquid stop valve (26). The heat source unit (20) is further provided with a heat source controller (27). Components of the heat source unit (20) are housed in a casing (not shown).

<Compressor and Four-Way Switching Valve>

The compressor (21) compresses a refrigerant sucked thereinto and discharges the compressed refrigerant. The four-way switching valve (22) switches between a first state (a state indicated by a solid line in FIG. 1) and a second state (a state indicated by a broken line in FIG. 1). In the first state, the first port and the fourth port communicate with each other, and the second port and the third port communicate with each other. In the second state, the first port and the second port communicate with each other, and the third port and the fourth port communicate with each other. In this example, the first port of the four-way switching valve (22) is connected to the discharge side of the compressor (21). The second port of the four-way switching valve (22) is connected to the gas stop valve (25). The third port of the four-way switching valve (22) is connected to the suction side of the compressor (21). The fourth port of the four-way switching valve (22) is connected to the gas end of the heat source heat exchanger (23).

<Heat Source Heat Exchanger>

The heat source heat exchanger (23) exchanges heat between the refrigerant and air. In this example, the liquid end of the heat source heat exchanger (23) is connected to the gas stop valve (25) through the heat source expansion valve (24). A heat source fan (23*a*) is provided in the vicinity of the heat source heat exchanger (23). The heat source fan (23*a*) transfers air to the heat source heat exchanger (23).

<Heat Source Expansion Valve>

The heat source expansion valve (24) reduces a pressure of the refrigerant as necessary. Specifically, the opening degree of the heat source expansion valve (24) is adjustable. Adjustment of the opening degree of the heat source expansion valve (24) allows adjustment of the flow rate of the refrigerant passing through the heat source expansion valve (24). This allows adjustment of the pressure of the refrigerant passing through the heat source expansion valve (24). For example, the heat source expansion valve (24) is configured as an electronic expansion valve having an adjustable opening degree.

<Stop Valve>

The gas stop valve (25) and the liquid stop valve (26) are switched between the closed state and the open state. For example, the gas stop valve (25) and the liquid stop valve (26) are switched to the closed state when the air conditioner (10) is installed, and are switched to the open state when the air conditioner (10) is used after the installation. In this example, the gas stop valve (25) is connected to one end of the gas connection pipe (11), and the liquid stop valve (26) is connected to one end of the liquid connection pipe (12).

<Heat Source Controller>

The heat source controller (27) is electrically connected to various sensors (not shown) such as a pressure sensor and a temperature sensor provided in the heat source unit (20). The heat source controller (27) communicates with utilization controllers (35), which will be described later. For example, the heat source controller (27) is connected to the utilization controllers (35) via communication lines. The heat source controller (27) controls components of the heat source unit (20) based on output signals from various sensors in the heat source unit (20) and information transmitted from the utilization controllers (35). In this example, the heat source controller (27) controls the compressor (21), the heat source fan (23*a*), and the heat source expansion valve (24).

For example, the heat source controller (27) is comprised of a processor and a memory electrically connected to the processor. The memory stores a program and information for operating the processor. The heat source controller (27) may be configured to communicate with another external apparatus in addition to the utilization controllers (35), which will be described later.

[Configuration of Utilization Unit]

Figure 2:
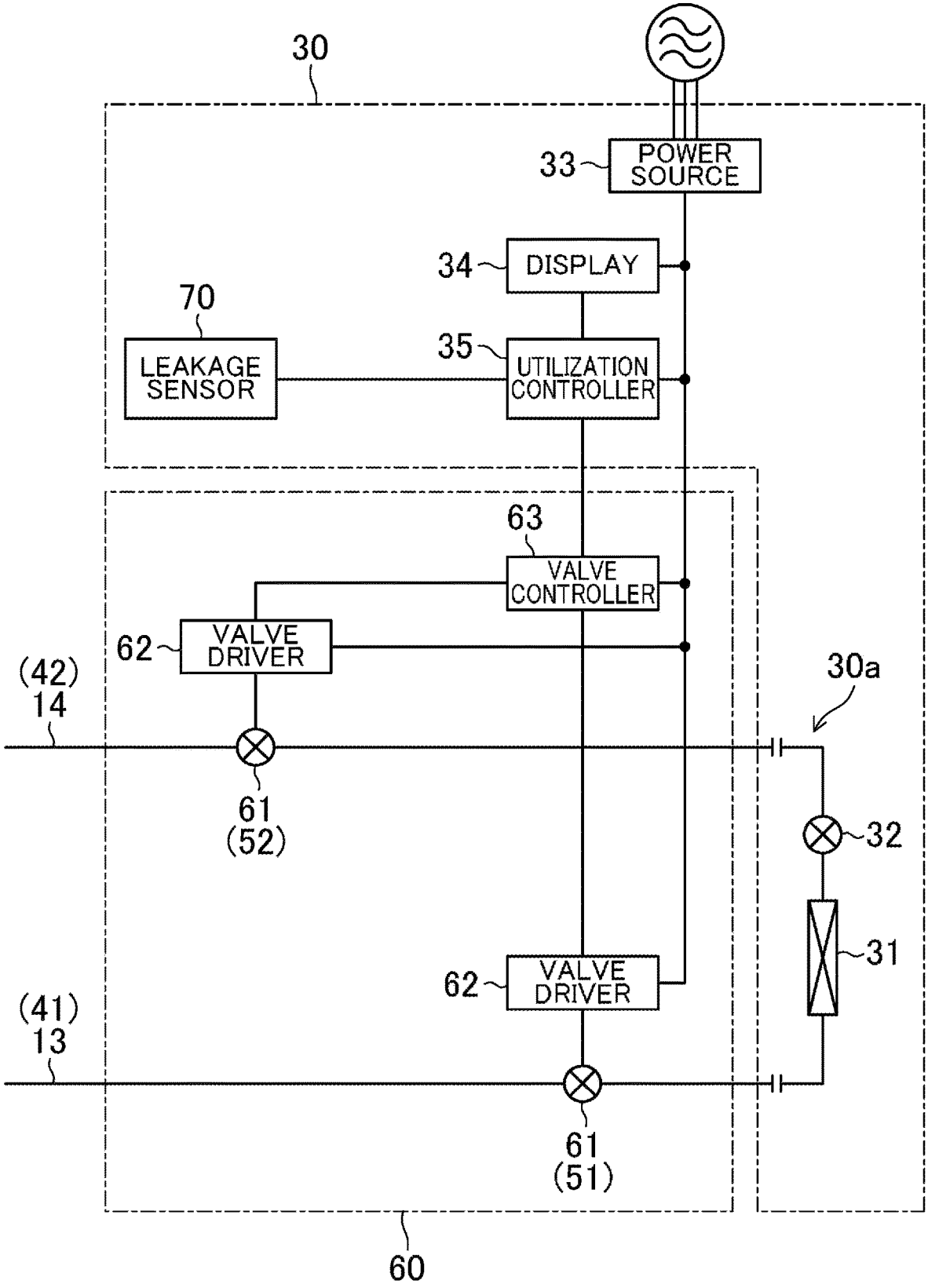
FIG. 2 is a block diagram illustrating configurations of a utilization unit and a cut-off unit.

Each of the utilization units (30) is provided with a utilization circuit (30*a*). The utilization circuit (30*a*) has a utilization heat exchanger (31), a utilization expansion valve (32), a gas-side joint, and a liquid-side joint. As illustrated in FIG. 2, the utilization unit (30) is provided with a power source (33), a display (34), and a utilization controller (35). Components of the utilization unit (30) are housed in a casing (not shown).

<Utilization Heat Exchanger>

The utilization heat exchanger (31) exchanges heat between the refrigerant and air. In this example, the gas end of the utilization heat exchanger (31) is connected to the gas branch pipe (13) constituting the first refrigerant channel (41). Specifically, the gas end of the utilization heat exchanger (31) is connected to the gas-side joint of the utilization circuit (30*a*), which is connected to the other end of the gas branch pipe (13). The liquid end of the utilization heat exchanger (31) is connected to the liquid branch pipe (14) constituting the second refrigerant channel (42) via the utilization expansion valve (32). Specifically, the liquid end of the utilization heat exchanger (31) is connected to the liquid-side joint of the utilization circuit (30*a*) via the utilization expansion valve (32), which is connected to the other end of the liquid branch pipe (14). A utilization fan (31*a*) is provided in the vicinity of the utilization heat exchanger (31). The utilization fan (31*a*) transfers air to the utilization heat exchanger (31).

<Utilization Expansion Valve>

Each of the utilization expansion valves (32) reduces a pressure of the refrigerant as necessary. Specifically, the opening degree of the utilization expansion valve (32) is adjustable. Adjustment of the opening degree of the utilization expansion valve (32) allows adjustment of the flow rate of the refrigerant passing through the utilization expansion valve (32). This allows adjustment of the pressure of the refrigerant passing through the utilization expansion valve (32). For example, the utilization expansion valve (32) is configured as an electronic expansion valve having an adjustable opening degree.

<Power Source>

The power source (33) is electrically connected to a power source system. Specifically, the utilization unit (30) is provided with a power plug (not shown) insertable into a receptacle (not shown) provided in the power source system, and a power cable (not shown) connecting between the power plug and the power source (33). Insertion of the power plug into the receptacle of the power source system makes an electrical connection between the power source system and the power source (33), thereby supplying electric power to the power source (33) from the power source system. In this example, the power source system is a configuration for supplying electric power from a commercial power source.

The power source (33) receives electric power from the power source system and supplies operating electric power. Components (e.g., the display (34) and the utilization controller (35)) of the utilization unit (30) operate using the operating electric power supplied from the power source (33). For example, the components of the utilization unit (30) are connected to the power source (33) via electric power lines. In this example, the electric power supplied from the power source system is AC electric power, and the operating electric power supplied from the power source (33) is DC electric power. For example, the power source (33) is configured as an AC/DC converter configured to convert AC electric power into DC electric power.

<Display>

The display (34) displays information. For example, the display (34) displays information on operation conditions of the utilization unit (30). In this example, the display (34) displays the open/close status of the first cut-off valve (51) and the open/close status of the second cut-off valve (52) in response to the control by the utilization controller (35). Specifically, the display (34) has first to fourth light-emitting elements (not shown) to be each switched between ON/OFF of lighting in response to the control by the utilization controller (35). When the first cut-off valve (51) is in the open state, the first light-emitting element is on, and the second light-emitting element is off. When the first cut-off valve (51) is in the closed state, the first light-emitting element is off, and the second light-emitting element is on. When the second cut-off valve (52) is in the open state, the third light-emitting element is on, and the fourth light-emitting element is off. When the second cut-off valve (52) is in the closed state, the third light-emitting element is off, and the fourth light-emitting element is on. For example, the first and third light-emitting elements are each configured as a light-emitting diode configured to emit light in a first emission color (e.g., green). The second and fourth light-emitting elements are each configured as a light-emitting diode configured to emit light in a second emission color (e.g., red) which is different from the first emission color.

<Utilization Controller>

The utilization controller (35) is electrically connected to various sensors (not shown) such as a pressure sensor and a temperature sensor provided in the utilization unit (30). The utilization controller (35) communicates with the heat source controller (27). For example, the utilization controller (35) is connected to the heat source controller (27) via a communication line. The utilization controller (35) controls components of the utilization unit (30) based on output signals from various sensors in the utilization unit (30) and information transmitted from the heat source controller (27). In this example, the utilization controller (35) controls the utilization fan (31*a*), the utilization expansion valve (32), and the display (34).

For example, the utilization controller (35) is comprised of a processor and a memory electrically connected to the processor. The memory stores a program and information for operating the processor. The utilization controller (35) may be configured to communicate with another external apparatus in addition to the heat source controller (27).

The utilization controller (35) further communicates with the valve controller (63), which will be described later. Operations of the utilization controller (35) and the valve controller (63) will be described in detail later.

[Cut-Off Valve]

As illustrated in FIG. 1, the air conditioner (10) includes a plurality of first cut-off valves (51) and a plurality of second cut-off valves (52). The first cut-off valves (51) are provided in the respective first refrigerant channels (41). The second cut-off valves (52) are provided in the respective second refrigerant channels (42). In other words, a combination of one first cut-off valve (51) and one second cut-off valve (52) is associated with a combination of one first refrigerant channel (41) and one second refrigerant channel (42). The combination of one first cut-off valve (51) and one second cut-off valve (52) is associated with at least one of the utilization units (30). In this example, the combination of one first cut-off valve (51) and one second cut-off valve (52) is associated with one of the utilization units (30).

The first cut-off valve (51) and the second cut-off valve (52) are switchable between the open state and the closed state. A combination of one first cut-off valve (51) and one second cut-off valve (52) is placed to be in the closed state from the open state in response to a leakage of the refrigerant in the utilization circuit (30*a*) of associated one of the utilization units (30).

At least one of the first cut-off valve (51) or the second cut-off valve (52) in the combination is an external cut-off valve (61) provided outside the utilization unit (30). Specifically, at least one of the first cut-off valve (51) or the second cut-off valve (52), serving as the external cut-off valve (61), is provided outside a casing (not shown) of associated one of the utilization units (30). The external cut-off valve (61) is driven using the operating electric power supplied from the power source (33) of the utilization unit (30). In this example, the first cut-off valve (51) and the second cut-off valve (52) both serve as an external cut-off valve (61).

[Cut-Off Unit]

In this example, the air conditioner (10) includes a plurality of cut-off units (60). The cut-off units (60) each include an external cut-off valve (61) serving as a first cut-off valve (51), and an external cut-off valve (61) serving as a second cut-off valve (52). In other words, one cut-off unit (60) is provided with a combination of one first cut-off valve (51) and one second cut-off valve (52). The cut-off units (60) each further include a valve driver (62) associated with the external cut-off valve (61) serving as the first cut-off valve (51), and a valve driver (62) associated with the external cut-off valve (61) serving as the second cut-off valve (52), and a valve controller (63). Components of the cut-off units (60) are housed in a casing (not shown).

In this example, one cut-off unit (60) is associated with one utilization unit (30). Each of the cut-off units (60) is supplied with operating electric power from the power source (33) of associated one of the utilization units (30). The valve driver (62) and the valve controller (63) of each of the cut-off units (60) receive the operating electric power supplied from the power source (33) of associated one of the utilization units (30). For example, the valve driver (62) and the valve controller (63) are connected to the power source (33) of the utilization unit (30) via electric power lines.

<External Cut-Off Valve>

The external cut-off valve (61) is driven using the operating electric power supplied from the power source (33) provided in the utilization unit (30). In this example, the operating electric power supplied from the power source (33) of the utilization unit (30) is transmitted to the external cut-off valve (61) via the valve driver (62).

Specifically, the external cut-off valve (61) has a valve body (not shown) and an actuator (not shown). The valve body of the external cut-off valve (61) has a refrigerant channel and a valve disc for opening/closing the refrigerant channel. The actuator of the external cut-off valve (61) is driven using the operating electric power supplied from the power source (33) to handle the valve disc of the valve body.

In this example, the external cut-off valve (61) is configured as a motor-operated valve having an adjustable opening degree. This motor-operated valve has a valve body having a refrigerant channel and a valve disc for adjusting the flow rate of the refrigerant passing through the refrigerant channel, and a motor (an example of the actuator) to be driven using the operating electric power to operate the valve disc of the valve body. For example, the motor-operated valve is a motor-operated ball valve. The motor-operated valve is driven by DC electric power.

<Valve Driver>

The valve driver (62) drives the external cut-off valve (61) using the electric power supplied from the power source (33) of the utilization unit (30). Specifically, the valve driver (62) supplies the electric power supplied from the power source (33) of the utilization unit (30) to the actuator of the external cut-off valve (61) to drive the associated external cut-off valve (61). For example, the valve driver (62) is configured as a drive circuit having a plurality of switching elements. The drive circuit receives electric power from the power source (33) and supplies the electric power to an actuator of the external cut-off valve (61) by switching operation of the switching elements. The switching operation of the valve driver (62) is controlled by a pulse signal. The valve driver (62) may be configured to convert electric power supplied from the power source (33) to desired electric power (specifically electric power suitable for the external cut-off valve (61)) and then supply the desired electric power to an actuator of the external cut-off valve (61).

<Valve Controller>

The valve controller (63) operates using electric power supplied from the power source (33) of the utilization unit (30). The valve controller (63) controls the valve driver (62) to control opening/closing of the external cut-off valve (61). For example, the valve controller (63) outputs a pulse signal to the valve driver (62) to control switching operation of the valve driver (62), thereby controlling opening/closing of the external cut-off valve (61).

In this example, the valve controller (63) of the cut-off unit (60) communicates with the utilization controller (35) of the utilization unit (30) associated with the cut-off unit (60). For example, the valve controller (63) is connected to the utilization controller (35) via a communication line. The valve controller (63) then controls the valve driver (62) based on information transmitted from the utilization controller (35). This controls the external cut-off valve (61).

For example, the utilization controller (35) is comprised of a processor and a memory electrically connected to the processor. The memory stores a program and information for operating the processor. The valve controller (63) may be configured to communicate with another external apparatus in addition to the utilization controller (35).

[Leakage Sensor]

The air conditioner (10) includes a plurality of leakage sensors (70). The leakage sensors (70) are associated with the respective utilization units (30). In this example, one utilization unit (30) is associated with one leakage sensor (70). Each of the leakage sensors (70) detects a leakage of the refrigerant in the utilization circuit (30*a*) of the utilization unit (30) associated with the leakage sensor (70). In this example, the leakage sensor (70) detects the amount of the refrigerant leaked in the utilization circuit (30*a*). Specifically, the leakage sensor (70) is installed in the utilization unit (30), and detects the amount of the refrigerant at the installation position as the amount of the refrigerant leaked in the utilization unit (30). For example, the leakage sensor (70) is installed in the casing (not shown) of the utilization unit (30). The leakage sensor (70) may be installed outside the utilization unit (30). An output signal from the leakage sensor (70) is transmitted to the utilization controller (35).

[Operation]

Next, the cooling operation and the heating operation performed by the air conditioner (10) will be described.

<Cooling Operation>

During the cooling operation, in the heat source unit (20), the compressor (21) and the heat source fan (23*a*) are driven, the four-way switching valve (22) is in the first state, and the heat source expansion valve (24) is in the open state. The opening degree of the heat source expansion valve (24) may be adjusted as necessary. In each of the utilization units (30), the utilization fan (31*a*) is driven, and the opening degree of the utilization expansion valve (32) is adjusted in accordance with the degree of superheat of the refrigerant flowing out of the utilization heat exchanger (31). Accordingly, a refrigeration cycle (cooling cycle) is performed using the heat source heat exchanger (23) as a condenser and the utilization heat exchanger (31) as an evaporator.

Specifically, during the cooling operation, the refrigerant discharged from the compressor (21) flows into the heat source heat exchanger (23) through the four-way switching valve (22), and then dissipates heat to the air in the heat source heat exchanger (23) to be condensed. The refrigerant that has flowed out of the heat source heat exchanger (23) flows into the liquid connection pipe (12) through the heat source expansion valve (24). The refrigerant that has flowed into the liquid connection pipe (12) flows into the utilization circuits (30*a*) of the respective utilization units (30) through the liquid branch pipes (14). In each of the utilization units (30), the refrigerant that has flowed into the utilization circuit (30*a*) through the liquid branch pipe (14) is decompressed in the utilization expansion valve (32), then, flows into the utilization heat exchanger (31), and absorbs heat from air in the utilization heat exchanger (31) to evaporate. This cools air in the utilization heat exchanger (31). The cooled air is transferred to a space to be air-conditioned. The refrigerant that has flowed out of the utilization heat exchanger (31) flows into the gas connection pipe (11) through the gas branch pipe (13). The refrigerant that has flowed into the gas connection pipe (11) passes through the four-way switching valve (22), and is then sucked into the compressor (21) to be decompressed.

<Heating Operation>

During the heating operation, in the heat source unit (20), the compressor (21) and the heat source fan (23*a*) are driven, the four-way switching valve (22) is in the second state, and the opening degree of the heat source expansion valve (24) is adjusted in accordance with the degree of superheat of the refrigerant flowing out of the heat source heat exchanger (23). In each of the utilization units (30), the utilization fan (31*a*) is driven, and the opening degree of the utilization expansion valve (32) is adjusted in accordance with the degree of subcooling of the refrigerant flowing out of the utilization heat exchanger (31). Accordingly, a refrigeration cycle (heating cycle) is performed using the utilization heat exchanger (31) as a condenser and the heat source heat exchanger (23) as an evaporator.

Specifically, during the heating operation, the refrigerant discharged from the compressor (21) passes through the four-way switching valve (22), and flows into the gas connection pipe (11). The refrigerant that has flowed into the gas connection pipe (11) flows into the utilization circuits (30*a*) of the respective utilization units (30) through the gas branch pipes (13). In each of the utilization units (30), the refrigerant that has flowed into the utilization circuit (30*a*) through the gas branch pipe (13) flows into the utilization heat exchanger (31), and then dissipates heat to the air in the utilization heat exchanger (31) to be condensed. This heats air in the utilization heat exchanger (31). The heated air is transferred to a space to be air-conditioned. The refrigerant that has flowed out of the utilization heat exchanger (31) flows into the liquid connection pipe (12) through the utilization expansion valve (32) and the liquid branch pipe (14). The refrigerant that has flowed into the liquid connection pipe (12) is decompressed in the heat source expansion valve (24), then flows into the heat source heat exchanger (23), and adsorbs heat from air in the heat source heat exchanger (23) to evaporate. The refrigerant that has flowed out of the heat source heat exchanger (23) passes through the four-way switching valve (22), and is then sucked into the compressor (21) to be decompressed.

[Operations of Utilization Controller and Valve Controller]

Next, operations of the utilization controller (35) and the valve controller (63) will be described in detail below. In the following description, the utilization controller (35) and display (34) provided in the utilization unit (30); the external cut-off valve (61), valve driver (62), and valve controller (63) provided in the cut-off unit (60) associated with the utilization unit (30); and the leakage sensor (70) associated with the utilization unit (30) will be described as an example. In this example, the first cut-off valve (51) and the second cut-off valve (52) both serve as an external cut-off valve (61).

The utilization controller (35) monitors an output from the leakage sensor (70) to determine the presence or absence of a leakage of the refrigerant in the utilization circuit (30*a*). In this example, the utilization controller (35) monitors the amount of the refrigerant leaked in the utilization circuit (30*a*), detected using the leakage sensor (70) to determine whether or not the amount is above the allowable amount set in advance.

<Operation before Leakage of Refrigerant>

The utilization controller (35) does not transmit, to the valve controller (63), a valve close command to place the external cut-off valve (61) in the closed state until detection of a leakage of the refrigerant in the utilization circuit (30*a*) (in other words, it is determined that the refrigerant is leaked in the utilization circuit (30*a*)). In this example, the utilization controller (35) does not transmit the valve close command to the valve controller (63) until the amount of the refrigerant leaked, detected using the leakage sensor (70), is above the allowable amount.

Further, the utilization controller (35) causes the display (34) to display the status where the external cut-off valve (61) is in the open state until the valve close command is transmitted. In this example, the utilization controller (35) causes the display (34) to display the status where the first cut-off valve (51) and the second cut-off valve (52) are in the open state. Specifically, the utilization controller (35) causes the first light-emitting element (a light-emitting element that displays the status where the first cut-off valve (51) is in the open state) and the third light-emitting element (a light-emitting element where the second cut-off valve (52) is in the open state) in the display (34) to be on, and causes the second light-emitting element (a light-emitting element that displays the status where the first cut-off valve (51) is in the closed state) and a fourth light-emitting element (a light-emitting element that displays the status where the second cut-off valve (52) is in the closed state) in the display (34) to be off.

The valve controller (63) does not perform a closing operation for placing the external cut-off valve (61) in the closed state until reception of the valve close command. The external cut-off valve (61) is in the open state until the valve controller (63) performs the closing operation. This keeps the external cut-off valve (61) in the open state. In this example, the first cut-off valve (51) and the second cut-off valve (52) are kept in the open state.

<Operation after Leakage of Refrigerant>

When detecting a leakage of the refrigerant in the utilization circuit (30*a*) (in other words, when determining that the refrigerant is leaked in the utilization circuit (30*a*)), the utilization controller (35) transmits a valve close command to the valve controller (63). In this example, when the amount of the leaked refrigerant detected using the leakage sensor (70) is above the allowable amount, the utilization controller (35) transmits the valve close command to the valve controller (63).

The utilization controller (35) transmits the valve close command and then causes the display (34) to display the status where the external cut-off valve (61) is in the closed state. In this example, the utilization controller (35) causes the display (34) to display the status where the first cut-off valve (51) and the second cut-off valve (52) are in the closed state. Specifically, the utilization controller (35) causes the second and fourth light-emitting elements in the display (34) to be on, and the first and third light-emitting elements in the display (34) to be off.

The utilization controller (35) may be configured to stop the utilization fan (31*a*) of the utilization unit (30) when detecting the leakage of the refrigerant in the utilization circuit (30*a*). Alternatively, the utilization controller (35) may be configured to cause the display (34) to display the status where the refrigerant is leaked in the utilization circuit (30*a*). For example, the display (34) is provided with an abnormality display element which is a light-emitting element to be on when the refrigerant is leaked in the utilization circuit (30*a*), and the utilization controller (35) causes the abnormality display element in the display (34) to be on when detecting the leakage of the refrigerant in the utilization circuit (30*a*).

When receiving the valve close command, the valve controller (63) controls the valve driver (62) to place the external cut-off valve (61) in the closed state. In this example, the valve controller (63) controls a valve driver (62) that drives the external cut-off valve (61) serving as a first cut-off valve (51), and a valve controller (63) that drives the external cut-off valve (61) serving as a second cut-off valve (52). This switches the first cut-off valve (51) and the second cut-off valve (52) to be in the closed state from the open state. When the first cut-off valve (51) and the second cut-off valve (52) are switched to be in the closed state from the open state, the utilization circuit (30*a*) of the utilization unit (30) is cut off from the heat source circuit (20*a*) of the heat source unit (20) to prevent the refrigerant from leaking from the utilization circuit (30*a*).

The valve controller (63) does not perform control for causing the external cut-off valve (61) to be in the open state, until a valve unclosing condition set in advance is established. This keeps the external cut-off valve (61) in the closed state until the valve unclosing condition is established. In this example, the first cut-off valve (51) and the second cut-off valve (52) are kept in the closed state. For example, the valve unclosing condition may be a condition (hereinafter referred to as the "first unclosing condition") for the valve controller (63) to receive a valve unclosing command to place the external cut-off valve (61) in the open state. Alternatively, the valve unclosing condition may be a condition (hereinafter referred to as the "second unclosing condition") to depress a reset button (not shown) provided in the cut-off unit (60). The valve unclosing condition may also be a condition to establish at least one of the first unclosing condition or the second unclosing condition.

Advantages of Embodiment

As described above, the air conditioner (10) of the present embodiment includes a refrigerant circuit (10*a*) including: a heat source circuit (20*a*) having a compressor (21) and a heat source heat exchanger (23); utilization circuits (30*a*) each having a utilization heat exchanger (31); first refrigerant channels (41) connected to respective gas ends of the utilization circuits (30*a*); and second refrigerant channels (42) connected to respective liquid ends of the utilization circuits (30*a*), and configured to circulate a refrigerant to perform a refrigeration cycle. The air conditioner (10) further includes: a heat source unit (20) provided with the heat source circuit (20*a*), utilization units (30) provided with the utilization circuits (30*a*), first cut-off valves (51) provided in the respective first refrigerant channels (41), and second cut-off valves (52) provided in the respective second refrigerant channels (42). The first cut-off valve (51) and the second cut-off valve (52) are placed in the closed state from the open state in response to the leakage of the refrigerant in the utilization circuit (30*a*). The utilization unit (30) has a power source (33) configured to receive electric power supplied from a power source system and supplies operating electric power. At least one of the first cut-off valve (51) or the second cut-off valve (52) is an external cut-off valve (61) provided outside the utilization unit (30). The external cut-off valve (61) is driven using the operating electric power supplied from the power source (33).

The present embodiment allows the cut-off valve (external cut-off valve (61)) provided outside the utilization unit (30), out of the first cut-off valve (51) and the second cut-off valve (52), to be driven using the operating electric power supplied from the power source (33) provided in the utilization unit (30).

In addition to the power source (33) in the utilization unit (30), a power source for supplying electric power to the external cut-off valve (61) is considered to be provided outside the utilization unit (30). However, such a configuration (e.g., a receptacle and a power plug) needs to further provide a configuration for electrically connecting between the power source system and the power source provided outside the utilization unit (30). Therefore, it is difficult to reduce the number of components (e.g., the number of power plugs) of the air conditioner (10) and the number of components (e.g., the number of receptacles) of the power source system.

In contrast, in the present embodiment, the operating electric power supplied from the power source (33) provided in the utilization unit (30) is supplied to the external cut-off valve (61). This configuration does not need to provide the power source for supplying electric power to the external cut-off valve (61) to the outside of the utilization unit (30). This allows reduction in the number of components (e.g., the number of power plugs) of the air conditioner (10) and the number of components (e.g., the number of receptacles) of the power source system, compared with the case where the power source for supplying electric power to the external cut-off valve (61) is provided outside the utilization unit (30).

Further, in the air conditioner (10) of the present embodiment, the operating electric power supplied from the power source (33) is DC electric power.

The present embodiment allows DC operating electric power to be supplied to the external cut-off valve (61) provided outside the utilization unit (30) even if the electric power supplied from the power source system is AC electric power. This enables utilization of a valve (e.g., motor-operated valve) driven by DC operating electric power as the external cut-off valve (61) without providing a configuration for converting the AC electric power supplied from the power source system to the DC electric power (e.g., an AC/DC converter) outside the utilization unit (30).

Further, in the present embodiment, the external cut-off valve (61) can be configured as a motor-operated valve (a motor-operated valve having an adjustable opening degree)

driven using the DC operating electric power. This configuration allows a reduction in power consumption necessary to drive the external cut-off valve (61), compared with the configuration where the external cut-off valve (61) is configured as an electromagnetic valve (an electromagnetic valve which is switchable between the open state and the closed state) driven using the AC electric power.

The air conditioner (10) of the present embodiment further includes cut-off units (60). The cut-off units (60) each have: an external cut-off valve (61); a valve driver (62) configured to drive the external cut-off valve (61) using the operating electric power supplied from the power source (33); and a valve controller (63) configured to operate using the operating electric power supplied from the power source (33) to control the valve driver (62), thereby controlling opening/closing of the external cut-off valve (61).

In the present embodiment, the valve driver (62) and the external cut-off valve (61) are both provided in the cut-off unit (60). This configuration allows an electric power line connecting between the external cut-off valve (61) and the valve driver (62) to be shortened, compared with the case where the valve driver (62) is not provided in the cut-off unit (60) together with the external cut-off valve (61) (e.g., the case where the external cut-off valve (61) is provided in the cut-off unit (60), while the valve driver (62) is provided in the utilization unit (30)). This enables a reduction in electric power loss occurring between the external cut-off valve (61) and the valve driver (62).

In the present embodiment, the external cut-off valve (61), the valve driver (62), and the valve controller (63) are all provided in the cut-off unit (60). This configuration allows the external cut-off valve (61), the valve driver (62), and the valve controller (63) to be easily installed, compared with the case where the external cut-off valve (61), the valve driver (62), and the valve controller (63) are individually installed.

The air conditioner (10) of the present embodiment further includes leakage sensors (70) configured to detect a leakage of the refrigerant in the respective utilization circuits (30*a*). The utilization units (30) each have a utilization controller (35). The utilization controller (35) monitors an output from the associated one of the leakage sensors (70), and transmits, to the valve controller (63), a valve close command to place the external cut-off valve (61) in the closed state when detecting a leakage of the refrigerant in the utilization circuit (30*a*). When receiving the valve close command, the valve controller (63) controls the valve driver (62) to place the external cut-off valve (61) in the closed state.

The present embodiment allows the utilization controller (35) provided in the utilization unit (30) to indirectly control the external cut-off valve (61) provided outside the utilization unit (30). This enables the external cut-off valve (61) to be placed in the closed state in response to a leakage of the refrigerant detected using the leakage sensor (70).

The air conditioner (10) of the present embodiment further includes displays (34). Each of the utilization controller (35) transmits the valve close command and then causes associated one of the displays (34) to display the status where associated one of the external cut-off valves (61) is in the closed state.

The present embodiment allows the status where the external cut-off valve (61) provided outside the utilization unit (30) is in the closed state to be notified by displaying the status on the display (34).

Further, in the air conditioner (10) of the present embodiment, the utilization controller (35) causes the display (34) to display the status where the external cut-off valve (61) is in the open state until the valve close command is transmitted.

The present embodiment allows the status where the external cut-off valve (61) provided outside the utilization unit (30) is in the open state to be notified by displaying the status on the display (34).

In the air conditioner (10) of this embodiment, the external cut-off valve (61) is configured as a motor-operated valve having an adjustable opening degree. A motor-operated valve having an adjustable opening degree can be closed firmly, compared with the electromagnetic valve which is switchable between the open state and the closed state. Specifically, the motor-operated valve can keep the valve disc at a closing position by applying a tightening torque to a valve disc in addition to the self weight of the valve, thereby allowed to be closed firmly, compared with the electromagnetic valve.

In the present embodiment, the external cut-off valve (61) is configured as a motor-operated valve having an adjustable opening degree. This configuration allows the external cut-off valve (61) to be closed firmly, compared with the configuration where the external cut-off valve (61) is configured as an electromagnetic valve which is switchable between the open state and the closed state. This enables a reduction in leakage of the refrigerant with the external cut-off valve (61) in the closed state (in other words, a leakage of the refrigerant passing through the external cut-off valve (61) in the closed state).

In the air conditioner (10) of the present embodiment, at least the first cut-off valve (51), out of the first cut-off valve (51) and the second cut-off valve (52), is an external cut-off valve (61) configured as a motor-operated valve having an adjustable opening degree.

In this embodiment, the first cut-off valve (51) is configured as a motor-operated valve having an adjustable opening degree. The first refrigerant channel (41) provided with the first cut-off valve (51) has a cross-sectional area (a pipe diameter of the gas branch pipe (13) in this example) larger than that (a pipe diameter of the liquid branch pipe (14) in this example) of the second refrigerant channel (42) provided with the second cut-off valve (52). Thus, the amount of the leaked refrigerant with the first cut-off valve (51) in the closed state is larger than the amount of the leaked refrigerant with the second cut-off valve (52) in the closed state. Thus, the first cut-off valve (51) configured as a motor-operated valve allows an effective reduction in leakage of the refrigerant with the first cut-off valve (51) in the closed state, compared with the case where the first cut-off valve (51) is configured as an electromagnetic valve.

First Variation of Embodiment

Figure 3:
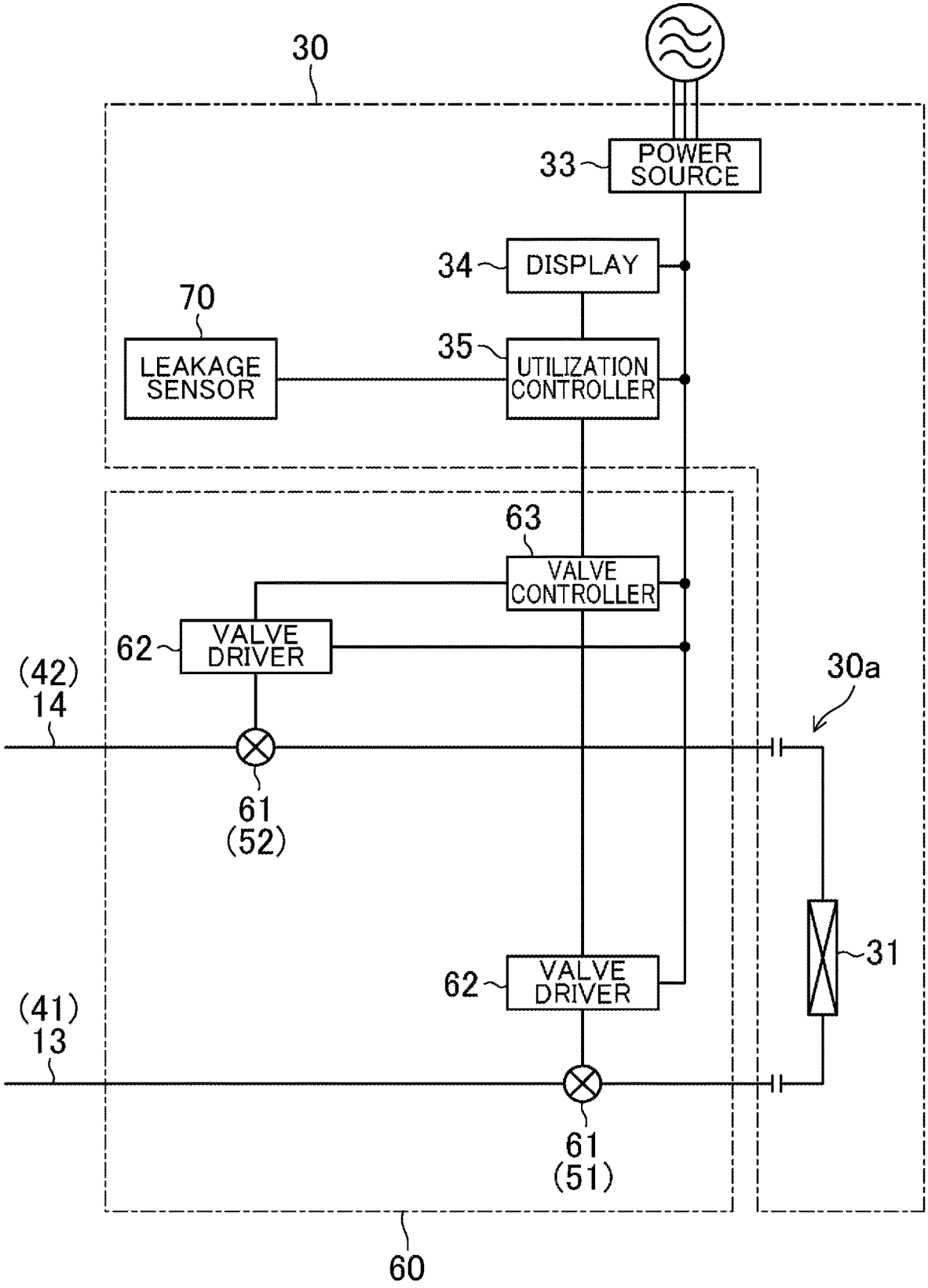
FIG. 3 is a block diagram illustrating configurations of a utilization unit and a cut-off unit in an air conditioner according to a first variation of the embodiment.

As illustrated in FIG. 3, the utilization expansion valve (32) may be omitted from the utilization circuit (30*a*). In the first variation, at least the second cut-off valve (52), out of the first cut-off valve (51) and the second cut-off valve (52), is an external cut-off valve (61) configured as a motor-operated valve having an adjustable opening degree. The second cut-off valve (52) also serves as an expansion valve for adjusting a pressure of the refrigerant flowing through the utilization circuit (30*a*).

For example, during the cooling operation, the opening degree of the second cut-off valve (52) is adjusted in accordance with the degree of superheat of the refrigerant flowing out of the utilization heat exchanger (31). During the heating operation, the opening degree of the second cut-off valve (52) is adjusted in accordance with the degree of subcooling of the refrigerant flowing out of the utilization heat exchanger (31).

As described above, in the air conditioner (10) of the first variation of the present embodiment, at least the second cut-off valve (52), out of the first cut-off valve (51) and the second cut-off valve (52), is an external cut-off valve (61) configured as a motor-operated valve having an adjustable opening degree. The second cut-off valve (52) also serves as an expansion valve for adjusting a pressure of the refrigerant flowing through the utilization circuit (30*a*).

In the first variation of the present embodiment, the second cut-off valve (52) is used as an expansion valve for adjusting the pressure of the refrigerant flowing through the utilization circuit (30*a*), thereby allowing omission of such an expansion valve from the utilization unit (30). This enables a reduction in the number of components of the utilization unit (30).

Second Variation of Embodiment

Figure 4:
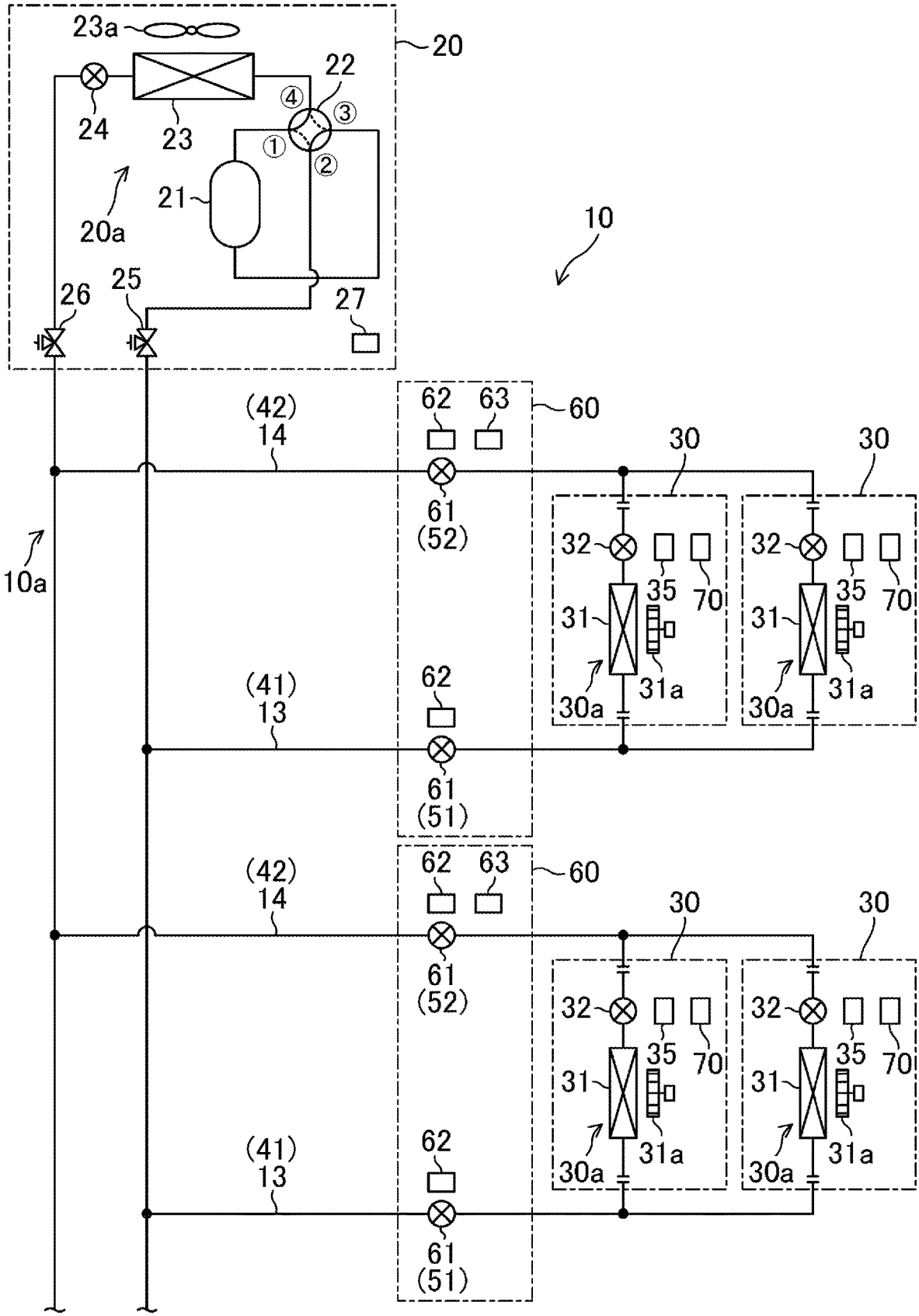
FIG. 4 is a piping system diagram illustrating a configuration of an air conditioner according to a second variation of the embodiment.

As illustrated in FIG. 4, a combination of one first refrigerant channel (41) and one second refrigerant channel (42) may be associated with two or more utilization units (30).

Third Variation of Embodiment

Figure 5:
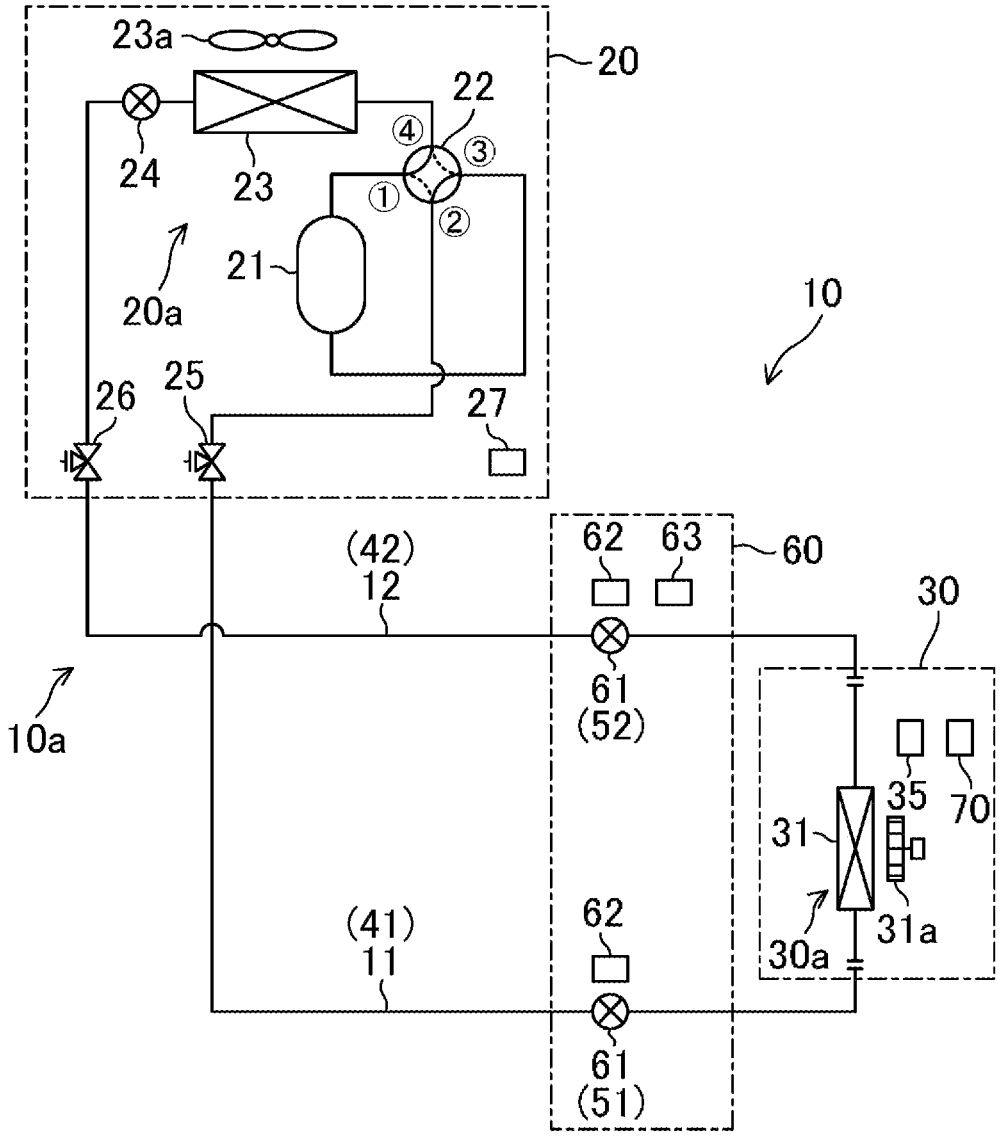
FIG. 5 is a piping system diagram illustrating a configuration of an air conditioner according to a third variation of the embodiment.

As illustrated in FIG. 5, the air conditioner (10) may be an air conditioner (a so-called pair-type air conditioner) including one heat source unit (20) and one utilization unit (30). In the third variation, a gas end of a utilization circuit (30*a*) provided in the utilization unit (30) is connected to a gas end of a heat source circuit (20*a*) provided in the heat source unit (20) via the gas connection pipe (11). A liquid end of the utilization circuit (30*a*) provided in the utilization unit (30) is connected to a liquid end of a heat source circuit (20*a*) provided in the heat source unit (20) via a liquid connection pipe (12). In this example, the first refrigerant channel (41) is configured as a gas connection pipe (11), and the second refrigerant channel (42) is configured as a liquid connection pipe (12).

Other Embodiments

The foregoing description uses the case where the external cut-off valve (61) is configured as a motor-operated valve as an example. However, the external cut-off valve (61) may be configured as an electromagnetic valve which is switchable between the open state and the closed state. The electromagnetic valve has a valve body having a refrigerant channel and a valve disc for opening/closing the refrigerant channel, and a solenoid (an example of an actuator) to be driven using operating electric power supplied from the power source (33) of the utilization unit (30) to operate the valve disc of the valve body. The electromagnetic valve is driven by AC electric power. A valve seat (a portion in sliding contact with the valve disc) provided in the valve body of such an electromagnetic valve may be made from brass or stainless steel, or may be made from an elastic resin such as Teflon (registered trademark). The valve seat of the electromagnetic valve made from an elastic resin in the electromagnetic valve allows a reduction in the amount of the leaked refrigerant in the electromagnetic valve, compared with the case where the valve seat of the electromagnetic valve is made from brass or stainless steel. Specifically, if the external cut-off valve (61) (specifically the first cut-off valve (51)) provided in the gas branch pipe (13) having a pipe diameter larger than the liquid branch pipe (14) is configured as an electromagnetic valve, the electromagnetic valve has a valve seat made from an elastic resin in one preferred embodiment.

Alternatively, an electromagnetic valve which is in the open state when electrified, and in the closed state when not electrified (in other words, a normally closed type electromagnetic valve) may be used as the external cut-off valve (61). The normally closed type electromagnetic valve used as the external cut-off valve (61) is allowed to be kept in the closed state during power failure due to non-supply of operating electric power from the power source (33) of the utilization unit (30). This can prevent the refrigerant from leaking from the utilization circuit (30*a*) during power failure.

Alternatively, an electromagnetic valve which is in the closed state when electrified, and in the open state when not electrified (in other words, a normally open type electromagnetic valve) may be used as the external cut-off valve (61). The normally open type electromagnetic valve used as the external cut-off valve (61) is allowed not to be electrified during normal heating operation and normal cooling operation. This allows an increase in energy conservation. The normally open type electromagnetic valve used as the external cut-off valve (61) allows a reduction in deterioration of a solenoid of the electromagnetic valve, compared with the normally closed type electromagnetic valve used as the external cut-off valve (61), thereby allowing improvement in durability of the external cut-off valve (61).

If the normally open type electromagnetic valve is used as the external cut-off valve (61), driving electric power is applied to the external cut-off valve (61) in order to drive the external cut-off valve (61) to be in the closed state, and keeping electric power is continuously applied to the external cut-off valve (61) in order to keep the external cut-off valve (61) in the closed state. The keeping electric power may be lower than the driving electric power. Specifically, the current continuously supplied to the solenoid of the electromagnetic valve in order to keep the electromagnetic valve in the closed state may be smaller than the current applied to the solenoid of the electromagnetic valve in order to place the electromagnetic valve in the closed state. Setting the keeping electric power to be smaller than the driving electric power as described above allows an increase in energy conservation.

The foregoing description uses the case where the display (34) is, but not limited thereto, disposed in the utilization unit (30). For example, the display (34) may be provided in a remote controller (not shown) of the air conditioner (10).

The utilization unit (30) may be a ceiling mounted type unit, a wall-hanging type unit, a floor standing type unit, or any other unit.

The foregoing description uses the case where the utilization controller (35) determines the presence or absence of leakage of the refrigerant in the utilization circuit (30*a*), based on the output from the leakage sensor (70). However, the leakage sensor (70) may determine the presence or absence of leakage of the refrigerant in the utilization circuit (30*a*). For example, the leakage sensor (70) may be configured to detect the amount of the refrigerant leaked in the utilization circuit (30*a*) and determine whether or not the amount is above the allowable amount. In this case, the utilization controller (35) monitors an output from the leakage sensor (70), and transmits a valve closing signal to the valve controller (63) when the leakage sensor (70) determines that the refrigerant is leaked in the utilization circuit (30*a*).

(Refrigerant)

The refrigerants used in the refrigerant circuit (10*a*) of the air conditioner (10) of the embodiments and variations are flammable refrigerants. The flammable refrigerant includes refrigerants falling under Class 3 (highly flammable), Class 2 (less flammable), and Subclass 2L (mildly flammable) in the standards of ASHRAE34 Designation and safety classification of refrigerant in the United States or the standards of ISO817 Refrigerants—Designation and safety classification. FIG. 6 shows specific examples of the refrigerants used in the embodiments and the variations. In FIG. 6, "ASHRAE Number" indicates the ASHRAE number of each refrigerant defined in ISO 817, "Component" indicates the ASHRAE number of each substance contained in the refrigerant, "mass %" indicates the concentration of each substance contained in the refrigerant by mass %, and "Alternative" indicates the name of an alternative to the substance of the refrigerant which is often replaced by the alternative. The refrigerant used in the present embodiment is R32. The examples of the refrigerants shown in FIG. 6 are characterized by having a higher density than air.

While the embodiments and variations thereof have been described above, it will be understood that various changes in form and details may be made without departing from the spirit and scope of the claims. The foregoing embodiments and variations thereof may be combined and replaced with each other without deteriorating the intended functions of the present disclosure.

INDUSTRIAL APPLICABILITY

As can be seen from the foregoing description, the present disclosure is useful as an air conditioner.

EXPLANATION OF REFERENCES

10 Air Conditioner
10*a* Refrigerant Circuit
20 Heat Source Unit
20*a* Heat Source Circuit
30 Utilization Unit
30*a* Utilization Circuit
41 First Refrigerant Channel
42 Second Refrigerant Channel
51 First Cut-Off Valve
52 Second Cut-Off Valve
60 Cut-Off Unit
61 External Cut-Off Valve
62 Valve Driver
63 Valve Controller
70 Leakage Sensor

The invention claimed is:

1. An air conditioner comprising:

a refrigerant circuit including: a heat source circuit having a compressor and a heat source heat exchanger; a utilization circuit having a utilization heat exchanger; a first refrigerant channel connected to a gas end of the utilization circuit; and a second refrigerant channel connected to a liquid end of the utilization circuit, and configured to circulate a refrigerant to perform a refrigeration cycle;

a heat source unit including the heat source circuit;

a utilization unit including the utilization circuit;

a first cut-off valve provided in the first refrigerant channel;

a second cut-off valve provided in the second refrigerant channel;

a cut-off unit; and a leakage sensor configured to detect a leakage of the refrigerant in the utilization circuit, the first cut-off valve and the second cut-off valve being placed in a closed state from an opened state in response to a leakage of the refrigerant in the utilization circuit, the utilization unit having a power source configured to receive electric power supplied from a power source system and supplies operating electric power, at least one of the first cut-off valve or the second cut-off valve being an external cut-off valve provided outside the utilization unit, and the external cut-off valve being driven using the operating electric power supplied from the power source, the cut-off unit having:

the external cut-off valve, a valve driver configured to drive the external cut-off valve using the operating electric power supplied from the power source; and a valve controller configured to operate using the operating electric power supplied from the power source to control the valve driver, thereby controlling opening/closing of the external cut-off valve, the utilization unit having a utilization controller, the utilization controller monitoring an output from the leakage sensor, and transmitting, to the valve controller, a command to place the external cut-off valve in the closed state when detecting the leakage of the refrigerant in the utilization circuit, and in response to receipt of the command, the valve controller controlling the valve driver to place the external cut-off valve in the closed state, the valve controller being configured such that the valve controller does not perform control for causing the external cut-off valve to be in the open state, until a valve unclosing condition is established, and the valve unclosing condition being a first unclosing condition for the valve controller to receive a valve unclosing command to place the external cut-off valve in the open state, or a second unclosing condition to depress a reset button provided in the cut-off unit.

2. A cut-off valve being any one of the external cut-off valve of the air conditioner of claim 1.

3. The air conditioner of claim 1, further comprising:

a display, wherein the utilization controller transmits the command and then causes the display to display a status where the external cut-off valve is in the closed state.

4. The air conditioner of claim 3, wherein the utilization controller causes the display to display a status where the external cut-off valve is in the open state until the command is transmitted.

5. The air conditioner of claim 1, wherein the external cut-off valve is configured as a motor-operated valve having an adjustable opening degree.

6. The air conditioner of claim 5, wherein at least the first cut-off valve out of the first cut-off valve and the second cut-off valve is the external cut-off valve that is configured as the motor-operated valve.

7. The air conditioner of claim 5, wherein at least the second cut-off valve out of the first cut-off valve and the second cut-off valve is the external cut-off valve that is configured as the motor-operated valve, and the second cut-off valve also serves as an expansion valve for adjusting a pressure of the refrigerant flowing through the utilization circuit.

8. The air conditioner of claim 1, wherein the operating electric power supplied from the power source is DC electric power.

9. The air conditioner of claim 8, wherein the external cut-off valve is configured as a motor-operated valve having an adjustable opening degree.

10. The air conditioner of claim 9, wherein at least the first cut-off valve out of the first cut-off valve and the second cut-off valve is the external cut-off valve that is configured as the motor-operated valve.

11. The air conditioner of claim 10, wherein at least the second cut-off valve out of the first cut-off valve and the second cut-off valve is the external cut-off valve that is configured as the motor-operated valve, and the second cut-off valve also serves as an expansion valve for adjusting a pressure of the refrigerant flowing through the utilization circuit.

* * * * *